US005949021A

United States Patent [19]

Kim

[11] Patent Number: 5,949,021

[45] Date of Patent: Sep. 7, 1999

[54] APPARATUS FOR FIXING A POWER CONTROL SWITCH OF A VACUUM CLEANER

[75] Inventor: Suk-Gu Kim, Seoul, Rep. of Korea

[73] Assignee: Daewoo Electronics, Co., Ltd., Seoul, Rep. of Korea

[21] Appl. No.: 08/997,471

[22] Filed: Dec. 23, 1997

[30] Foreign Application Priority Data

Dec. 27, 1996 [KR] Rep. of Korea ..... 96-73441

[51] Int. Cl.[6] ..... H01H 9/02

[52] U.S. Cl. ..... 174/57; 174/66; 220/241

[58] Field of Search ..... 174/54, 66, 57; 220/241, 3.8; 403/329; 248/27.1, 27.3

[56] References Cited

U.S. PATENT DOCUMENTS

| | | | |
|---|---|---|---|
| 689,138 | 12/1901 | Stahley | 174/66 X |
| 2,522,172 | 9/1950 | Gates | 248/27.1 X |
| 3,866,868 | 2/1975 | Fish et al. | 248/27 |
| 4,340,795 | 7/1982 | Arthur | 248/27.3 X |

*Primary Examiner*—Dean A. Reichard
*Attorney, Agent, or Firm*—Pillsbury Madison & Sutro LLP

[57] ABSTRACT

Disclosed is an apparatus in which various types of power control switches are selectively fixed to a vacuum cleaner. The apparatus for fixing a power control switch to a vacuum cleaner according to the present invention includes a pair of first bosses for fixing a first power control switch which is selected from the various types of power control switches to a body of the vacuum cleaner, and a pair of brackets which are integrally formed together with the first bosses, respectively, for enclosing and supporting the first power control switch. The apparatus also includes a pair of second bosses for fixing a second power control switch which is selected from the various types of power control switches to the body of the vacuum cleaner. In the apparatus according to the present invention, the power control switch which is selected from the various types of the power control switches is mounted and fixed to the first bosses and the brackets, or the second bosses and the brackets according to a type of the power control switch. Therefore, there is an advantage in that a user can use the various types of the power control switches according to his/her preference.

14 Claims, 6 Drawing Sheets

APPARATUS FOR FIXING A POWER CONTROL SWITCH OF A VACUUM CLEANER

BACKGROUND OF THE INVENTION

1. Field of the Invention

The present invention relates to a vacuum cleaner, and more particularly to an apparatus for fixing a power control switch in a vacuum cleaner.

2. Description of the Prior Art

A vacuum cleaner is an apparatus for sucking dust and alien substances by using suction air which is generated by a driving force of an electric motor mounted in the vacuum cleaner. The dust and the alien substances which are sucked into the vacuum cleaner are filtered and collected by means of a paper bag filter accommodated in an attachable/detachable manner in a dust collecting chamber. As a result, the suction air is cleaned and exhausted outside.

Generally, vacuum cleaners are divided into a canister type of vacuum cleaner and an upright type of vacuum cleaner. The canister type of vacuum cleaner includes a body and a suction pipe assembly which is connected to the body, for sucking dust, alien substances, and the like. The upright type of vacuum cleaner does not have no a suction pipe assembly. Instead, a working head thereof is positioned below a body of the vacuum cleaner.

Recently, the canister type of the vacuum cleaner is generally used rather than the upright type of the vacuum cleaner.

FIG. 1 is a perspective view of a canister type of vacuum cleaner according to the conventional art. Referring to FIG. 1, the vacuum cleaner has a body 10 in which an electric motor and a paper bag filter are accommodated. A pair of wheels 11 are mounted on both sides of the body 10. A suction pipe 12 having a flexible pipe 12*a* and an extended pipe 12*b* is connected to an upper surface of a front portion of body 10 at one end thereof, and is connected to a working head having a brush 13 at the other end thereof. When the electric motor contained in body 10 rotates, dust and alien substances are sucked through the suction pipe 12 into body 10. A handle 14 and an indicator 15 for showing a quantity of collected dust are mounted on the upper surface of body 10. An electric power on/off switch 16, a power control switch 17, and a code reel button 18 are disposed at an upper rear portion of body 10. A reference numeral 19 which is not described above denotes an electric wire.

Generally, vacuum cleaners have the power control switch to control an appropriate cleaning power corresponding to a condition of cleaning. In the vacuum cleaner according to the conventional art as constructed above, however, there is a disadvantage in that when the power control switch is out of order or when a user wants to replace an old power control switch with a new power control switch according to his or her preference, the user cannot replace the old power control switch with a new control switch. Also, there is another disadvantage in that when user wants to replace the old power control switch with a new power control switch, a separate supporting member is needed on the body of the vacuum cleaner. Therefore, the cost of the vacuum cleaner is highered.

SUMMARY OF THE INVENTION

The present invention has been made to overcome the above described problem of the prior art. It is an object of the present invention to provide an apparatus for fixing a power control switch to a vacuum cleaner wherein the power control switch is selected from various types of power control switches and can be changeable to an other type of a power control switch.

To accomplish the above object of the present invention, there is provided an apparatus for fixing a power control switch to a vacuum cleaner wherein the power control switch is selected from various types of power control switches, the apparatus comprising:

a pair of first bosses for fixing a first power control switch which is selected from the various types of the power control switches to a body of the vacuum cleaner;

a pair of brackets which is integrally formed with the first bosses, respectively, for enclosing and supporting the first power control switch; and a pair of second bosses for fixing a second power control switch which is selected from the various types of the power control switches to the body of the vacuum cleaner.

Each of the brackets is respectively integrated with each of first bosses as to be symmetrical to each other. Also, the brackets have an arc shape. A straight line passing through the second bosses is coincident to a symmetry line of the brackets. The symmetry line of the first bosses intersects normal to the straight line of the second bosses and has the same length as that of the straight line.

The body of the vacuum cleaner has a depression formed on a surface thereof, and the first bosses, the brackets, and the second bosses are integrally formed together with the depression.

The apparatus for fixing the power control switch to the vacuum cleaner further comprises a cover for covering the depression, wherein the cover has a thruhole in order that the first power control switch fixed to the first bosses and the brackets and the second power control switch fixed to the second bosses extend through the thruhole toward an outside of the depression so that they can be controlled by a user. Surfaces of the body defining the depression have slots therein, and the cover has latches which are in correspondence to and inserted into the slots.

In the apparatus for fixing the power control switch to the vacuum cleaner according to the present invention, the power control switch which is selected from the various types of the power control switches is mounted and fixed to either the first bosses and the brackets, or the second bosses and the brackets according to a type of the power control switch. Therefore, there is an advantage in that a user can use the various types of the power control switches according to his/her preference.

BRIEF DESCRIPTION OF THE DRAWINGS

The above object and other advantages of the present invention will become more apparent by describing in detail the preferred embodiment thereof with reference to the attached drawings, in which.

Figure 4A:
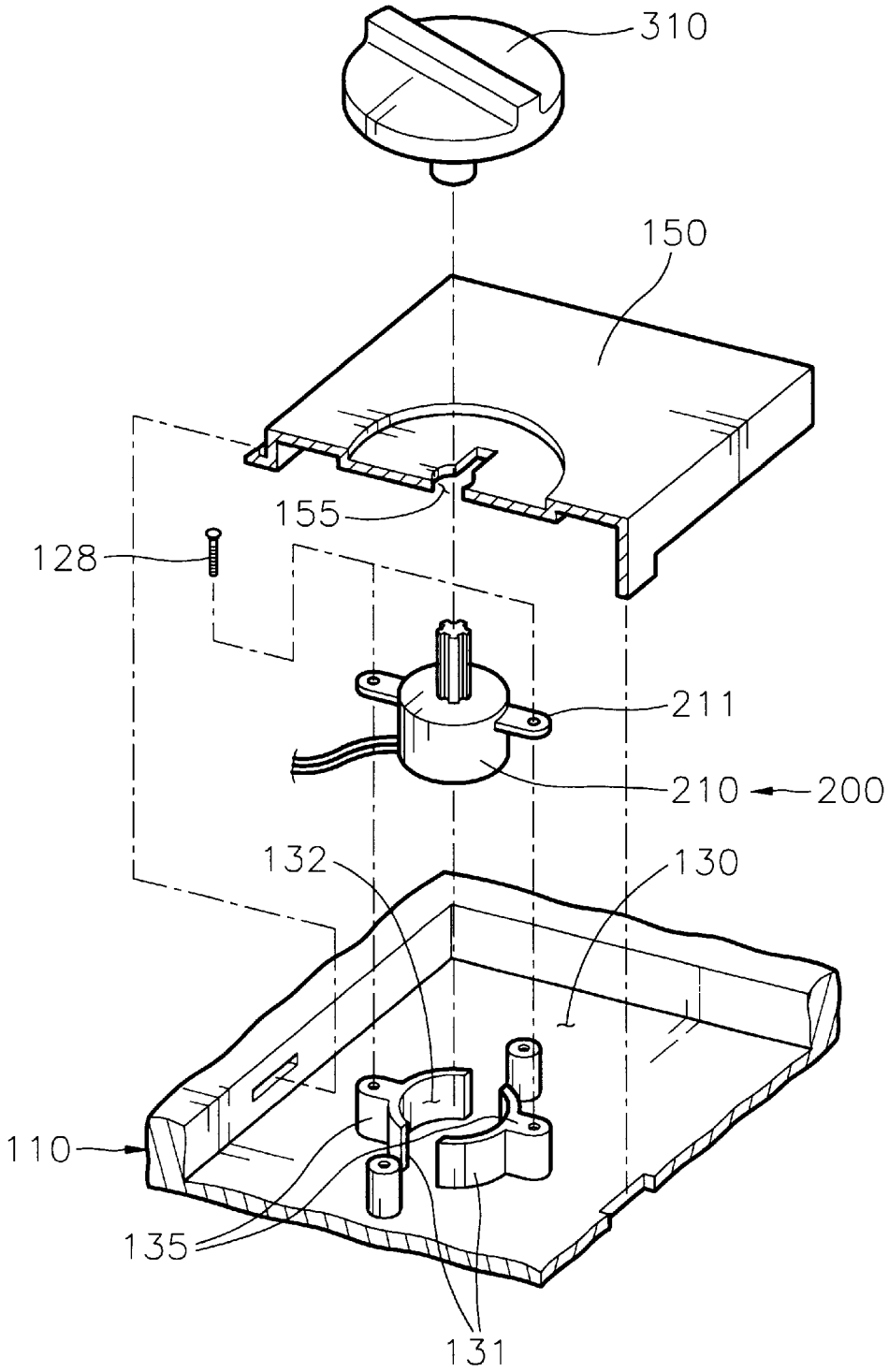
FIGS. 4A, 4B, and 4C are exploded perspective views of the cover and the depression of the vacuum cleaner in FIG. 2, in which a rotary type of a power control switch is disposed on the depression of the vacuum cleaner in FIG.
Figure 4B:
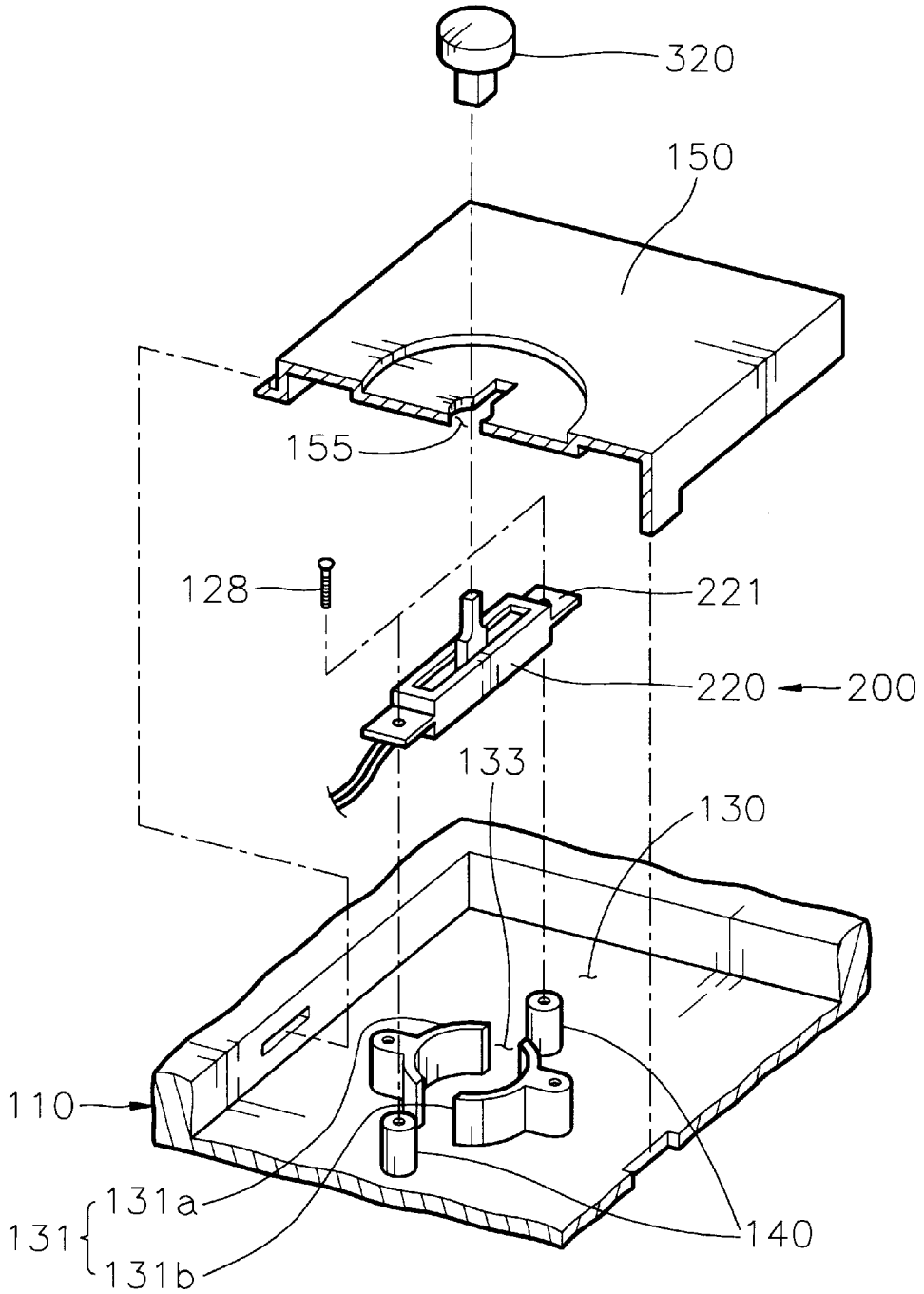
Figure 4C:
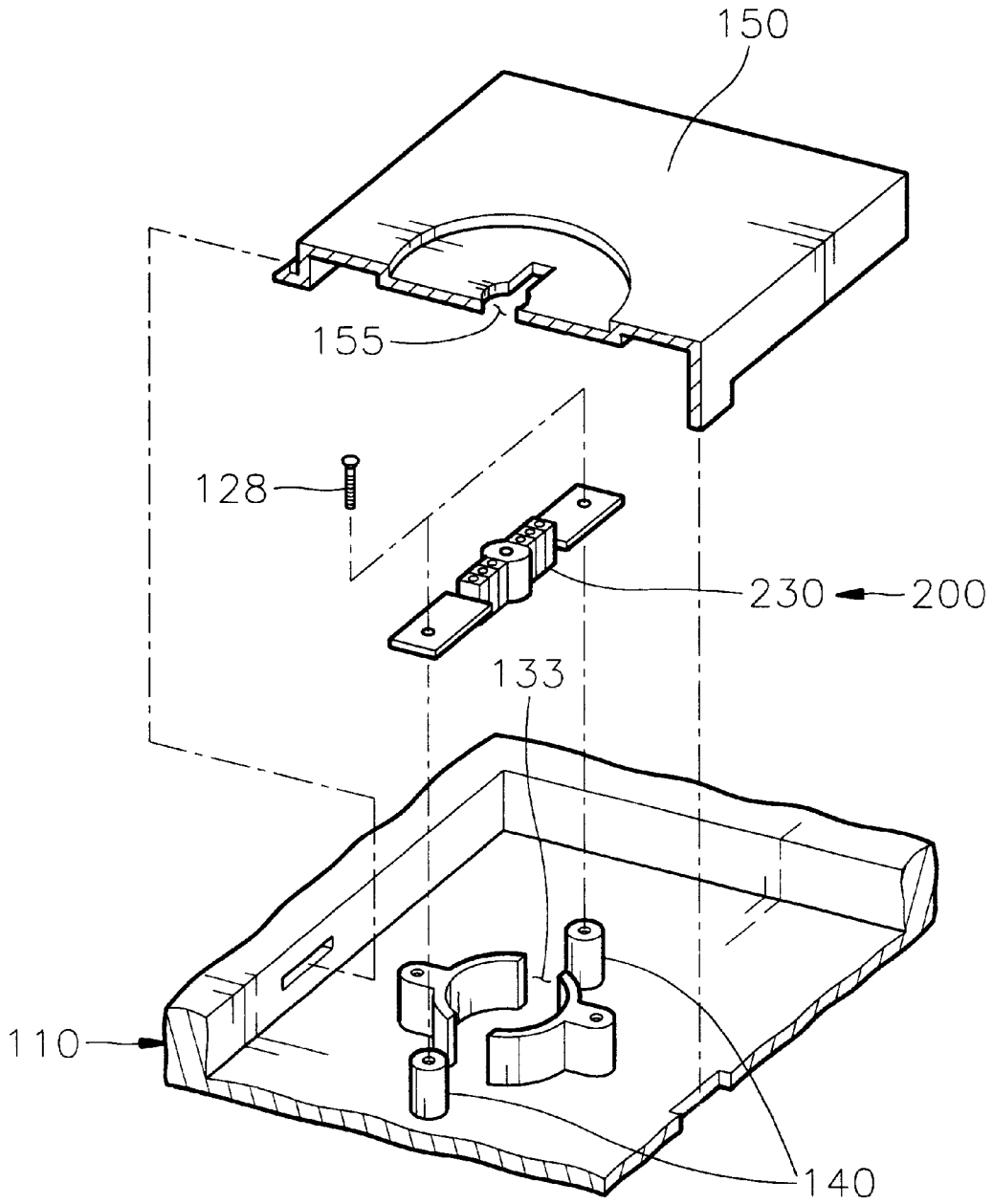

4A, a slide type of a power control switch is disposed on the depression of the vacuum cleaner in FIG. 4B, and a remote control type of a power control switch is disposed on the depression of the vacuum cleaner in FIG. 4C.

DESCRIPTION OF THE PREFERRED EMBODIMENT

Hereinafter, a vacuum cleaner according to a preferred embodiment of the present invention will be described in detail with reference to the accompanying drawings.

Figure 1:
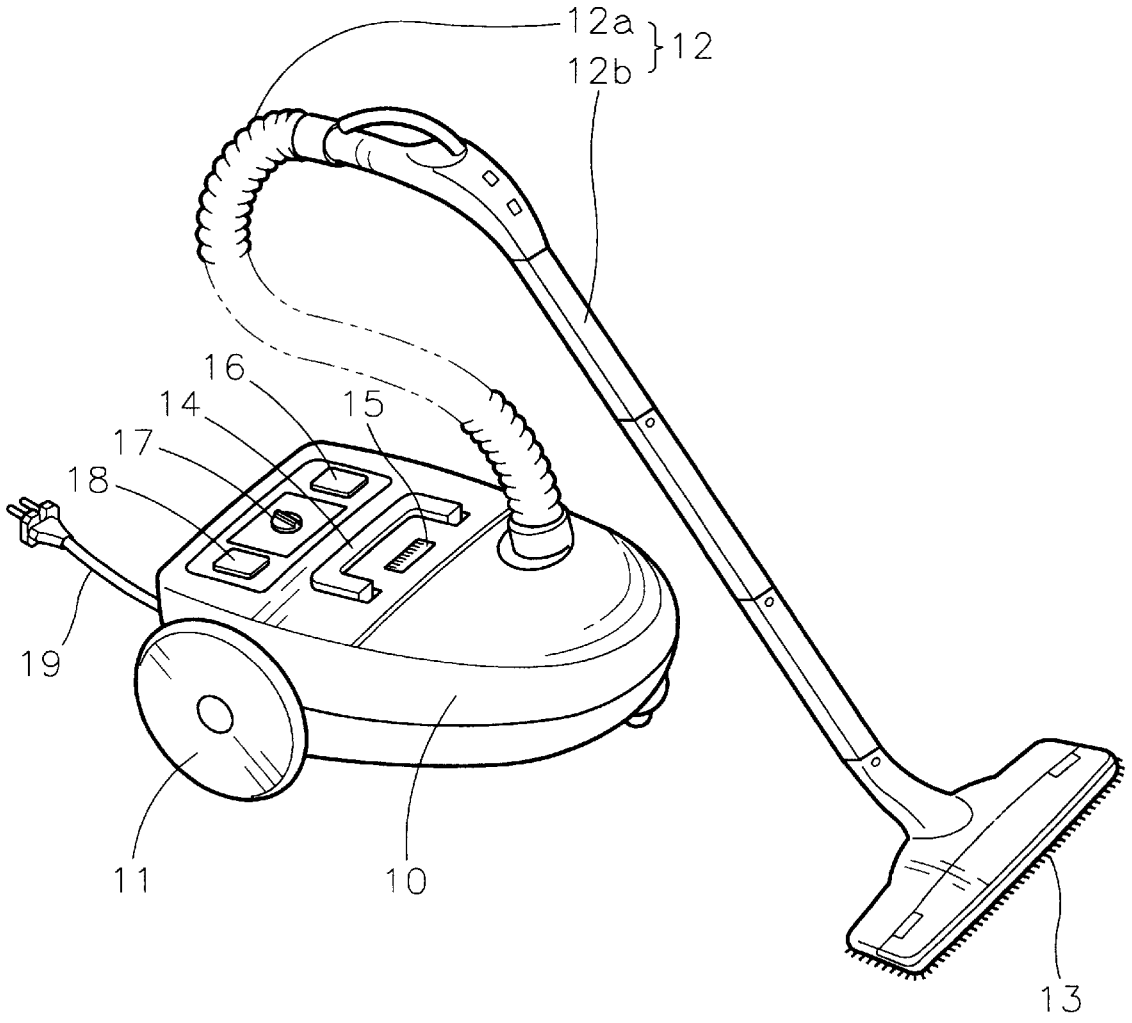
FIG. 1 (PRIOR ART)
FIG. 1 is a perspective view of a canister type of vacuum cleaner according to the conventional art.
Figure 2:
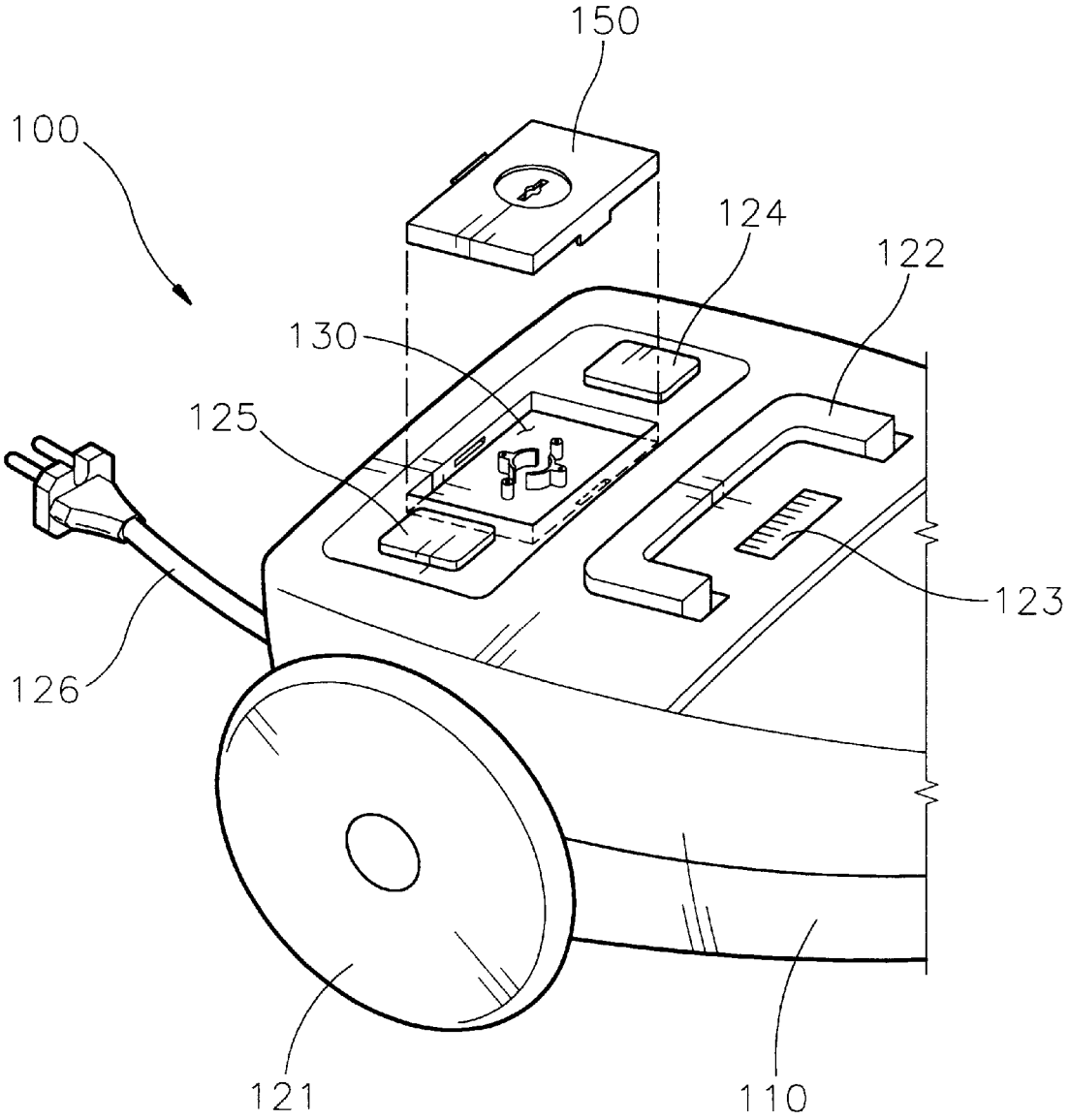
FIG. 2 is a partially perspective view of a vacuum cleaner according to an embodiment of the present invention.
Figure 3:
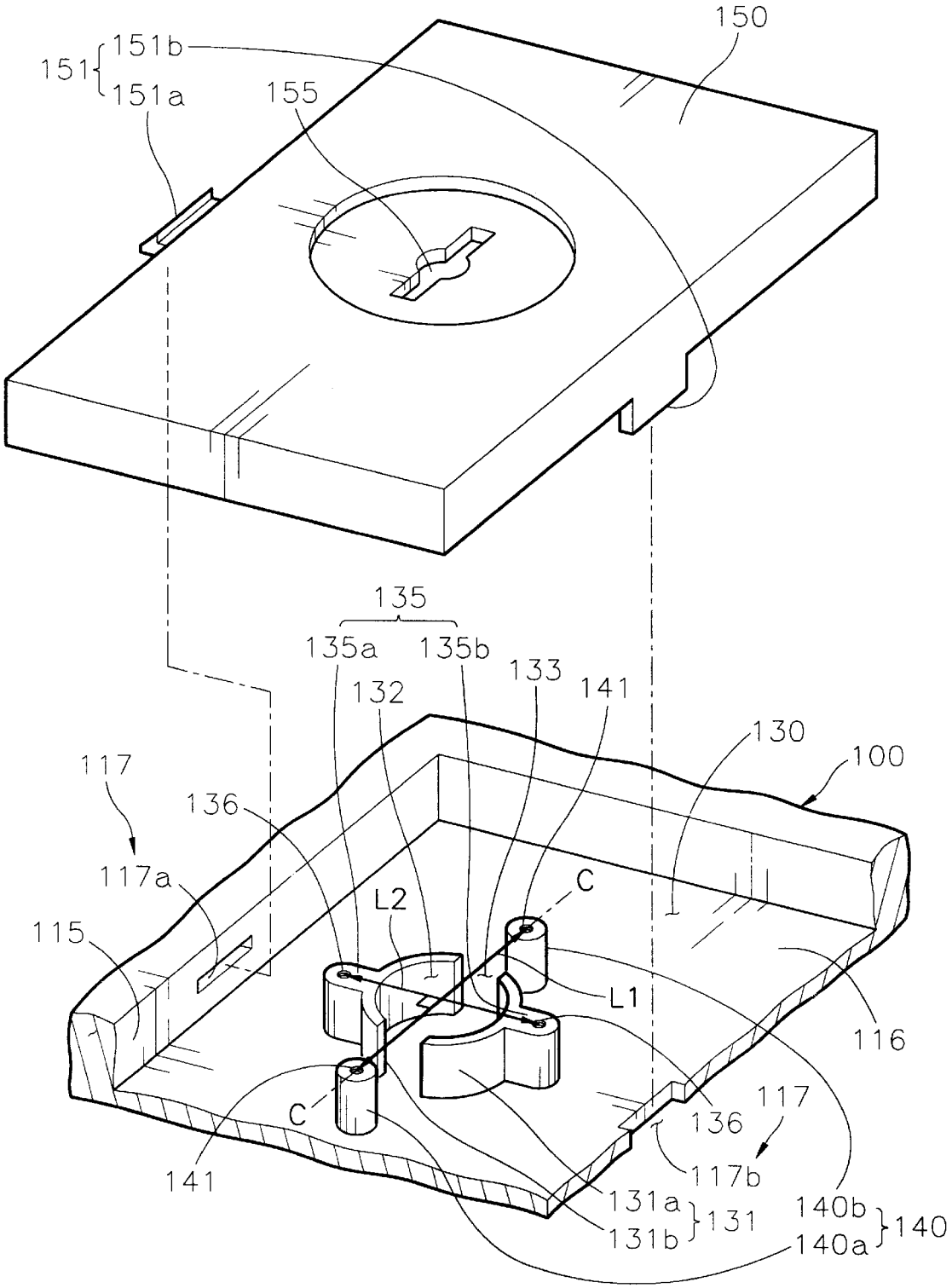
FIG. 3 is an enlarged perspective view of a cover and a depression of the vacuum cleaner in FIG. 2.

FIG. 2 is a partially perspective view of a vacuum cleaner according to an embodiment of the present invention, and FIG. 3 is an enlarged perspective view of a cover and a depression of the vacuum cleaner in FIG. 2.

As shown in FIGS. 2 and 3, vacuum cleaner 100 includes a body 110, in which an electric motor (not shown) and a paper bag filter (not shown) are accommodated, and a pair of wheels 121 which are mounted on both sides of body 110. Vacuum cleaner 100 sucks air including dust and alien substances through a suction pipe (not shown) into body 110. The paper bag filter contained in body 110 filtrates and collects the dust and the alien substances from the sucked air. Then, vacuum cleaner 100 exhausts the filtrated air to the outside thereof. Vacuum cleaner 100 also has a handle 122 mounted on an upper surface of body 110 so that a user can grab body 110. Vacuum cleaner 100 includes an indicator 123 which is disposed at a position near handle 122 on the upper surface of body 110 so as to display a quantity of the dust and alien substances collected by means of the paper bag filter. An electric power on/off switch 124 and a code reel button 125 are disposed on a rear upper surface of body 110. When the code reel button 125 is pushed, an electric wire 126, which is exposed to the outside environment of body 110, is wound on a code reel (not shown) installed in an interior of body 110.

Referring to FIGS. 4A, 4B, and 4C, it is understood that various types of power control switches 200, which are used for controlling the suction force of vacuum cleaner 100, can be mounted on vacuum cleaner 100. Vacuum cleaner 100 according to the present invention has an apparatus for fixing the various types of power control switches to body 110 thereof.

FIG. 3 is an enlarged perspective view of a cover and a depression of the vacuum cleaner in FIG. 2. As shown in FIG. 3, vacuum cleaner 100 has a depression 130 formed at the upper rear portion of body 110 of the vacuum cleaner 100. A pair of first bosses 135*a* and 135*b*, a pair of first brackets 131*a* and 131*b*, and a pair of second bosses 140*a* and 140*b* are integrally formed with the body 110 in depression 130.

Each of the first bosses 135*a* and 135*b* has a hole 136 in which each of screws 128 (see FIG. 4) are placed for fixing a power control switch 200 to body 110 of the vacuum cleaner 100. First brackets 131*a* and 131*b* are integrally formed together with first bosses 135*a* and 135*b*, respectively, and extend from first bosses 135*a* and 135*b*. Accordingly, a predetermined space 132 is defined between first brackets 131*a* and 131*b*. A first power control switch 210 is disposed in space 132, which is selected from various types of power control switches (see FIG. 4A). Ends of first brackets 131*a* and 131*b* are symmetrically spaced apart from each other. First brackets 131*a* and 131*b* are opposed to each other and are symmetrical around a straight line C—C passing through space 132 between ends of first brackets 131*a* and 131*b*.

Second bosses 140*a* and 140*b* are formed at positions near first brackets 131*a* and 131*b*. More particularly, second bosses 140*a* and 140*b* are formed at an outside of first brackets 131*a* and 131*b* so that a straight line L1 passing through centers of second bosses 140*a* and 140*b* is coincident with the straight line C—C. Also, second bosses 140*a* and 140*b* respectively have screw a hole 141 in which screws 128 passing through a power control switch 200 are inserted. A second power control switch 220 (see FIG. 4B), which is selected from various types of power control switches 200 and fixed to second bosses 140*a* and 140*b*, is disposed in a predetermined space 133 defined between ends of first brackets 131*a* and 131*b*.

As described above, first bosses 135*a* and 135*b* are formed to be opposed to each other. A straight line L2 passing through first bosses 135*a* and 135*b* preferably intersects to the straight line L1 passing second bosses 140*a* and 140*b*. More preferably, the straight line L1 has the same length as that of the straight line L2. Accordingly, first bosses 135*a* and 135*b* and second bosses 140*a* and 140*b* can be used interchangeably.

A cover 150 is mounted in an attachable/detachable manner at depression 130 in order to prevent an introduction of alien substances. Cover 150 has latches 151 extending by a predetermined distance from sides of cover 150 toward an outside, and a surface of body 110 which defines depression 130 has slots 117 which are formed therein in order to receive latches 151. That is, cover 150 has a first latch 151*a* formed at a side thereof and a second latch 151*b* formed at the other side thereof. An end portion of first latch 151*a* is bent and an end portion of second latch 151*b* is not bent. Also, the first latch 151*a* is a elastic. A first slot 117*a* in which first latch 151*a* is inserted is perforated in a vertical surface 115 of body 110 which defines depression 130, and a second slot 117*b* in which second latch 151*b* is inserted is perforated in a horizontal surface of body 110 which defines depression 130. In a state of inserting second latch 151*b* into second slot 117*b*, a user pushes an upper portion of cover 150 on which first latch 151*a* is formed, so as to insert first latch 151*a* into first slot 117*a*. Since the end portion of first latch 151*a* is bent, cover 150 is tightly connected to body 110 so as not to separate from depression 130. To open cover 150, when a portion of cover 150 which has second latch 151*b* formed thereon is raised upward, first latch 151*a* is removed from first slot 117*a*. At that time, since the end of second latch 151*b* is not bent, it is easy to remove second latch 151*b* from second slot 117*b*.

When the various types of power control switches 200 are fixed to first bosses 135*a* and 135*b* and brackets 131*a* and 131*b*, or second bosses 140*a* and 140*b* and brackets 131*a* and 131*b*, and when depression 130 is covered by means of cover 150, it is impossible to operate power control switch 200. To operate power control switch 200, cover 150 must have a thruhole 155 in order that the power control switch 200 can extend through thruhole 155 to the outside of depression 130. A handle is mounted at an end of the power control switch 200 so that the user can operate power control switch 200 by rotating and moving the handle.

Hereinafter, a method of fixing the various types of power control switche 200 to the vacuum cleaner according to the present invention as described above will be described in detail with reference to FIGS. 4A, 4B, and 4C. FIGS. 4A, 4B, and 4C are exploded perspective views of the cover and the depression of the vacuum cleaner in FIG. 2, in which a rotary type of a power control switch is disposed on the depression of the vacuum cleaner in FIG. 4A, a slide type of a power control switch is disposed on the depression of the vacuum cleaner in FIG. 4B, and a remote control type of a power control switch is disposed on the depression of the vacuum cleaner in FIG. 4C.

Referring to FIG. 4A, a rotary type of a first power control switch 210 is inserted into space 132 which is defined by brackets 131*a* and 131*b* so that connection plates 211 of first power control switch 210 are connected to first bosses 135*a* and 135*b* by screws. Then, first power control switch 210 is connected to a control section (not shown) which is contained in body 110, and depression 130 is covered by means of cover 150. A first handle 310 is mounted at an end of a shaft of a first power control switch 210 which extends through thruhole 155 so that the user can operate first power control switch 210 by rotating first handle 310.

Referring to FIG. 4B, connection plates 221 of a slide type of a second power control switch 220 are connected to second bosses 140*a* and 140*b* by screws. Second power control switch 220 is inserted into space 133 which is defined by brackets 131*a* and 131*b* so as to be tightly fixed to body 110. Then, second power control switch 220 is connected to the control section (not shown) which is contained in body 110, and depression 130 is covered by means of cover 150. A second handle 320 corresponding to second power control switch 220 is mounted at an end of a shaft of second power control switch 220 which extends through thruhole 155 so that the user can operate second power control switch 220 by sliding second handle 320.

FIG. 4C shows a remote control type of a third power control switch 230. Third power control switch 230 can be mounted in depression 130 in such a manner as second power control switch 220 in FIG. 4B.

In the apparatus for fixing the power control switch to the vacuum cleaner according to the present invention as described above, the power control switch which is selected from the various types of the power control switches is mounted and fixed to the first bosses and the brackets, or the second bosses and the brackets according to a type of the power control switch. Therefore, there is an advantage in that a user can use the various types of the power control switches according to his/her preference.

While the present invention has been particularly shown and described with reference to a particular embodiment thereof, it will be understood by those skilled in the art that various changes in form and detail may be effected therein without departing from the spirit and scope of the invention as defined by the appended claims.

What is claimed is:

1. An apparatus for fixing a power control switch to a vacuum cleaner wherein the power control switch is selected from various types of power control switches, the apparatus comprising:

a pair of first bosses for fixing a first power control switch which is selected from the various types of power control switches to a body of said vacuum cleaner;

a pair of brackets which is integrally formed with said first bosses, respectively, for enclosing and supporting said first power control switch; and a pair of second bosses for fixing a second power control switch which is selected from the various types of power control switches to said body of said vacuum cleaner.

2. An apparatus for fixing a power control switch to a vacuum cleaner as claimed in claim 1, wherein each of said brackets respectively is integrated with each of said first bosses so as to be symmetrical to each other.

3. An apparatus for fixing a power control switch to a vacuum cleaner as claimed in claim 2, wherein said brackets each have an arc shape.

4. An apparatus for fixing a power control switch to a vacuum cleaner as claimed as claim 2, wherein a straight line passing through said second bosses is coincident to a symmetry line of said brackets.

5. An apparatus for fixing a power control switch to a vacuum cleaner as claimed as claim 4, wherein the symmetry line of said brackets intersects the straight line passing through said second bosses and has a length equal to that of the straight line.

6. An apparatus for fixing a power control switch to a vacuum cleaner as claimed as claim 1, wherein said body of said vacuum cleaner has a depression formed on a surface thereof and said first bosses, said brackets, and said second bosses are integrally formed with said depression.

7. An apparatus for fixing a power control switch to a vacuum cleaner as claimed as claim 6, further comprising a cover for covering said depression, wherein said cover has a thruhole in order that said first power control switch fixed to said first bosses and said brackets or said second power control switch fixed to said second bosses extend through the thruhole toward an outside of said depression as that they are controlled by a user.

8. An apparatus for fixing a power control switch to a vacuum cleaner as claimed as claim 7, wherein surfaces of said body defining said depression have slots therein, and said cover has latches which are in correspondence to and inserted into the slots.

9. An apparatus for fixing a power control switch to a vacuum cleaner wherein the power control switch is selected from various types of power control switches, the apparatus comprising:

a pair of first bosses for fixing a first power control switch which is selected from the various types of power control switches to a body of said vacuum cleaner;

a pair of brackets which is respectively integrated with each of said first bosses so as to be symmetrical to each other, for enclosing and supporting said first power control switch; and a pair of second bosses for fixing a second power control switch which is selected from the various types of power control switches to said body of said vacuum cleaner, wherein a straight line passing through said second bosses is coincident to a symmetry line of said brackets.

10. An apparatus for fixing a power control switch to a vacuum cleaner as claimed in claim 9, wherein said brackets each have an arc shape.

11. An apparatus for fixing a power control switch to a vacuum cleaner as claimed as claim 9, wherein the symmetry line of said brackets intersects the straight line passing through said second bosses and has a length equal to that of the straight line.

12. An apparatus for fixing a power control switch to a vacuum cleaner as claimed as claim 9, wherein said body of said vacuum cleaner has a depression formed on a surface thereof and said first bosses, said brackets, and said second bosses are integrally formed together with said depression.

13. An apparatus for fixing a power control switch to a vacuum cleaner as claimed as claim 12, further comprising a cover for covering said depression, wherein said cover has a thruhole in order that said first power control switch fixed to said first bosses and said brackets or said second power control switch fixed to said second bosses extend through the thruhole toward an outside of said depression so that they are controlled by a user.

14. An apparatus for fixing a power control switch to a vacuum cleaner as claimed as claim 13, wherein surfaces of said body defining said depression have slots therein and said cover has latches which are in correspondence to and inserted into the slots.

* * * * *